US005839934A

United States Patent [19]

Hattori

[11] Patent Number: 5,839,934

[45] Date of Patent: Nov. 24, 1998

[54] MANUFACTURE OF FIELD EMISSION ELEMENT HAVING EMITTER SELF-ALIGNED WITH SMALL DIAMETER GATE OPENING

[75] Inventor: Atsuo Hattori, Hamamatsu, Japan

[73] Assignee: Yamaha Corporation, Japan

[21] Appl. No.: 700,010

[22] Filed: Aug. 20, 1996

[30] Foreign Application Priority Data

Aug. 25, 1995 [JP] Japan ..... 7-240723

[51] Int. Cl.[6] ..... H01J 9/02

[52] U.S. Cl. ..... 445/24

[58] Field of Search ..... 445/24

[56] References Cited

U.S. PATENT DOCUMENTS 5,141,459 8/1992 Zimmerman .
5,203,731 4/1993 Zimmerman .
5,334,908 8/1994 Zimmerman .
5,720,641 2/1998 Hattori ..... 445/24 X

*Primary Examiner*—Kenneth J. Ramsey
*Attorney, Agent, or Firm*—Ostrolenk, Faber, Gerb & Soffen, LLP

[57] ABSTRACT

A first polysilicon film is deposited on a substrate and selectively etched to form a gate opening having a vertical side wall. Next, a second polysilicon film is deposited and anisotropically etched to form a side spacer on the side wall of the gate opening. The exposed surface of the first polysilicon and side spacer is oxidized to form a silicon oxide film having a cusp with a sharp edge over the gate opening. Thereafter, an emitter electrode material film is formed on the silicon oxide film to form a tip of a field emission emitter in the cusp. Lastly, the silicon oxide film around the field emission emitter is removed. A method of manufacturing a field emission type element of high performance is provided in which a field emission emitter having a small radius of curvature and small apex angle of the emitter tip is formed in self-alignment with a small diameter gate opening.

6 Claims, 6 Drawing Sheets

MANUFACTURE OF FIELD EMISSION ELEMENT HAVING EMITTER SELF-ALIGNED WITH SMALL DIAMETER GATE OPENING

BACKGROUND OF THE INVENTION a) Field of the Invention

The present invention relates to a manufacture method of a field emission element with a gate electrode, and more particularly to a field emission element having a field emission emitter self-aligned with a gate opening.

b) Description of the Related Art

Such vacuum microdevice technologies using fine pattern fabrication of semiconductor integrated circuits have recently been attracting attentions, that manufacture fine cold cathode electron sources, and apply them to ultra-fine amplification devices, integrated circuits, flat displays, and the like. For practical vacuum microdevices, it is essential to develop cold cathode electron sources capable of stably emitting electrons at a low voltage. Cold cathode electron sources are roughly classified into two types, i.e. field emission type elements which emit electrons from a sharp edge of an emitter by the help of a concentrated electric field, and the other type elements which generate high energy electrons in semiconductor through avalanche or the like and taking them out to the external. Field emission emitter structures are generally classified into a vertical emitter whose needle-like sharp tip is formed perpendicular to the substrate surface, and a lateral emitter whose tip is formed planar along the substrate surface.

In order to form a vertical type field emission emitter, it is preferable to form an emitter mold having a sharp cusp. The methods of forming a field emission emitter are mainly classified into (1) using sacrificial film deposition, (2) using a reactive film, and (3) using anisotropic etching.

For an integrated field emission type element array, it is necessary to form fine field emission emitters in a matrix shape and at the same time integrally form gate electrodes for driving field emission emitters. One of typical methods conventionally proposed for manufacturing such field emission type elements with gate electrodes is disclosed, for example, in U.S. Pat. No. 5,203,731 in which a gate electrode material film is deposited on a substrate and selectively etched to form a recess (gate opening), an insulating film is deposited on the gate electrode material film by a film forming process with good step coverage, the insulating film having at its surface a sharp cusp which serves as an emitter mold, and finally an emitter electrode material is deposited on the insulating film. By removing the insulating film in the gate opening and around the emitter tip, an element having a field emission emitter self-aligned with the gate opening can be formed.

It is desired that an integrated field emission type element array can emit electrons at as small a voltage as possible. To this end, the gate opening is required to be small and the distance between the gate and emitter electrodes is required to be short. However, in manufacturing a typical field emission type element conventionally proposed, the gate opening is formed through selective etching by photolithography techniques. Therefore, the size of the gate opening is determined by the minimum patterning limit of photolithography and cannot be reduced more than this patterning limit. An insulating film is deposited by a film forming process with good step coverage on a substrate having a gate opening with a vertical side wall formed by anisotropic etching. In this case, in order to form an emitter mold having a sharp cusp, the insulating film is required to be deposited relatively thick. It becomes therefore difficult to shorten the distance between the emitter tip and gate electrodes.

SUMMARY OF THE INVENTION

It is an object of the present invention to provide a method of manufacturing a field emission type element of high performance in which a field emission emitter having a small radius of curvature and small apex angle of the emitter tip is formed in self-alignment with a small diameter gate opening.

According to one aspect of the present invention, there is provided a method of manufacturing a field emission type element comprising the steps of: forming a first gate electrode material film on a substrate; selectively etching the first gate electrode material film to form a gate opening having a vertical or generally vertical side wall; forming a second gate electrode material film on the first gate electrode material film formed with the gate opening; anisotropically etching the second gate electrode material film to form a side spacer on the side wall of the gate opening; reacting the exposed surface of the first gate electrode material film and the side spacer under a reactive atmosphere to form film comprising a material selected from a group consisting of oxide and nitride having a cusp with a sharp edge over the gate opening; forming an emitter electrode material film on the oxide film or the nitride film to form a tip of a field emission emitter in the cusp; and removing the oxide film or the nitride film around the field emission emitter.

The term "substantially vertical" means vertical or nearly vertical, allowing variations due to process parameters, provided that the resulting structure satisfies the requirement of stably forming a sharp cusp.

The side spacer of the second gate electrode material film is formed at the gate opening formed in the first gate electrode material film, so that a gentle slope can be formed on the side wall of the gate opening. Since these gate electrode material films are oxidized or nitrided to form the cusp of the emitter mold, the cusp has a downward taper and a small apex angle. Further, each cusp can be formed to have the same shape with good reproductivity, as opposed to the case where the shape of a cusp formed by film deposition largely depends upon the film deposition conditions. It is therefore possible to form a field emission emitter having a small apex angle and small radius of curvature of the emitter tip, with excellent process controllability.

Since the gate electrode is formed by the side spacer and first gate electrode material film, the diameter of the gate opening can be easily made smaller than the patterning limit of photolithography. Further, since the shape of the emitter mold is mainly determined by the opening formed in the first gate electrode material film and the side spacer of the second gate electrode material film, a thin oxide or nitride film can be used. Therefore, a field emission type element capable of emitting electrons at a low gate voltage can be realized.

As described above, a gentle slope can be formed on the gate opening side wall and the cusp after oxidation or nitrification can have a downward taper and a small apex angle. Therefore, a field emission emitter having a small apex angle and a small radius of curvature can be realized.

The diameter of the gate opening can be made smaller than the patterning limit of photolithography, and the reactive film such as an oxide or nitride film can be made thin. Therefore, a field emission type element capable of emitting electrons at a low gate voltage can be formed.

DETAILED DESCRIPTION OF THE PREFERRED EMBODIMENTS

Embodiments of the present invention will be described with reference to the accompanying drawings.

Figure 1A:
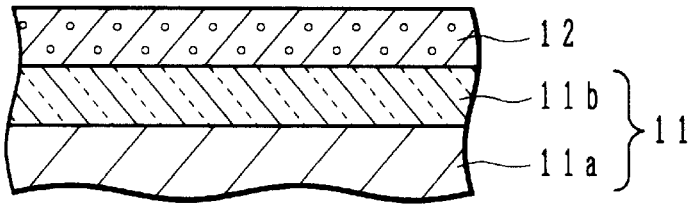
FIGS. 1A to 1H are cross sectional diagrams illustrating the main processes of the manufacture method of a field emission type element according to an embodiment of the invention.

FIGS. 1A to 1H illustrate the main processes of the manufacture method of a field emission type element according to an embodiment of the invention. As shown in FIG. 1A, a substrate 11 is prepared which has a silicon oxide film 11*b* formed on the surface of an anode electrode 11*a*. On this substrate 11, a first polysilicon film 12 as a first gate electrode material film is deposited by low pressure CVD. The condition for the low pressure CVD is as follows:

| | |
|---|---|
| Gas: | $N_2 + SiH_4$ |
| Flow rate: | $N_2$ = 3 SLM |
| | $SiH_4$ = 0.6 SLM |
| Total pressure: | 30 Pa |
| Temperature: | 625° C. |

The anode electrode 11*a* is made of, for example, doped silicon. The first polysilicon film 12 is doped with phosphorous. The doping condition is as follows:

| | |
|---|---|
| Source: | $POCl_3$ (50 mg) |
| Gas: | $N_2 + O_2$ |
| Flow rate: | $N_2$ = 7.5 SLM |
| | $O_2$ = 0.1 SLM |
| Temperature: | 850° C. |

Figure 1B:
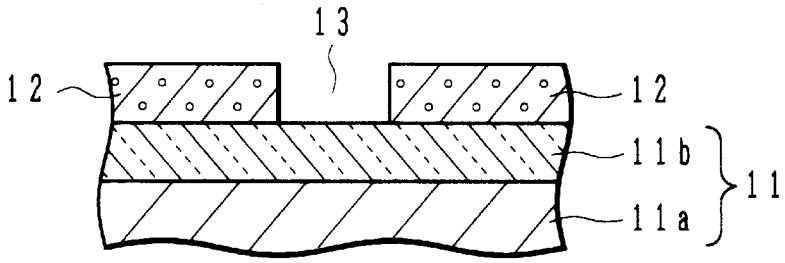

As shown in FIG. 1B, a resist pattern is formed on the first polysilicon film 12 by usual photolithography. By using this resist pattern as a mask, the first polysilicon film 12 is selectively etched through reactive ion etching (RIE) using a magnetron RIE etcher to form a gate opening 12 having a vertical side wall or a substantially vertical side wall. The etching condition is as follows:

| | |
|---|---|
| Etching gas: | HBr |
| Flow rate: | 60 sccm |
| Total pressure: | 100 mTorr |
| RF power: | 150 W |
| Magnetic field: | 30 Gauss |

The substrate is also cooled with He gas flow (4 Torr). The side wall of the gate opening 13 may have other shapes if an opening 13*a* after the formation of a side spacer to be later described can be formed to gradually increase its aperture in the height direction. Therefore, the side wall is not required strictly to be vertical, but it may be substantially vertical. In the case of the substantially vertical side wall, it is preferable that the opening 13 has an upward taper.

Figure 1C:
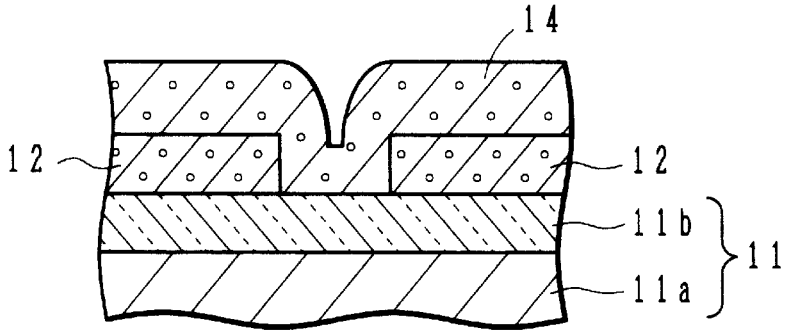

Next, as shown in FIG. 1C, a second polysilicon film 14 as a second gate electrode material film is deposited by low pressure CVD, similar to the first gate electrode material layer. The second polysilicon film 14 is also doped with phosphorous. The thickness of this second polysilicon film 14 can be precisely controlled, which in turn controls the thickness (width) of the resulting side spacer.

Figure 1D:
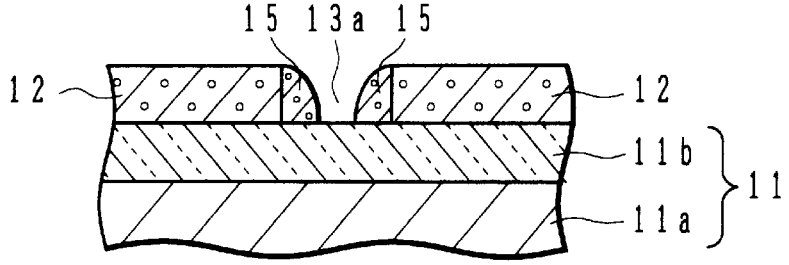

As shown in FIG. 1D, the whole surface of the second polysilicon film 14 is etched by anisotropic dry etching to remove those portions on flat underlying surfaces and to leave a side spacer 15 on the side wall of the gate opening 13. The etching condition is the same as the above.

The thickness of the side spacer 15 is controlled by the thickness of the second polysilicon film 14. This side spacer 15 forms a new gate opening 13*a* having a diameter smaller than the gate opening 13. A gentle slope is formed on the side wall of the gate opening 13*a*, and the diameter and volume of the gate opening 13*a* can be reduced.

Figure 1E:
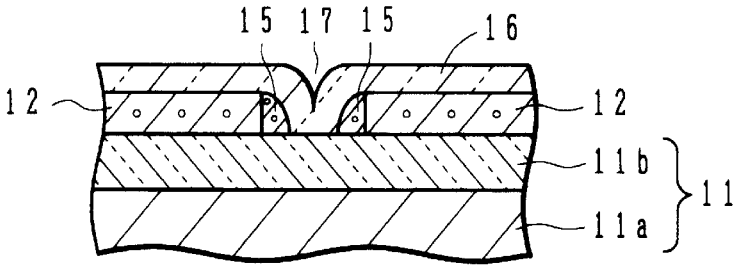

Next, as shown in FIG. 1E, the exposed surface of the first polysilicon film 12 and the side spacer 15 made of polysilicon is oxidized with a vertical type furnace to form a silicon oxide film 16. Oxidation of polysilicon may use wet oxidation, dry oxidation, plasma oxidation, or the like. The condition is as follows:

| | |
|---|---|
| Gas: | $N_2 + O_2$ |
| Flow rate: | $N_2$ = 19 SLM |
| | $O_2$ = 19 SLM |
| Temperature: | 1000° C. |

The silicon oxide film 16 is used as an emitter mold. A cusp 17 having a sharp edge is formed on the surface of the silicon oxide film 16 over the surface of the gate opening 13*a*.

During this oxidation, both the first gate electrode polysilicon film 12 and the side spacer 15 are oxidized. The volume of the silicon oxide film 16 expands when it is changed from polysilicon so that the surface of the silicon oxide film 16 moves in the direction outward of the polysilicon film 12. With this volume expansion, the side wall of the gate opening 13*a* moves inward and eventually buries the lower portion of the gate opening. In this manner, the cusp 17 having a sharp edge is formed on the surface of the silicon oxide film 16. As the oxidation further progresses, the position of the bottom (sharp edge) of the cusp 17 gradually rises.

Instead of the silicon oxide film 16, a silicon nitride film may be formed. In forming a silicon nitride film, thermal nitrification, plasma nitrification, ammonium nitrification, or the like may be used.

Figure 1F:
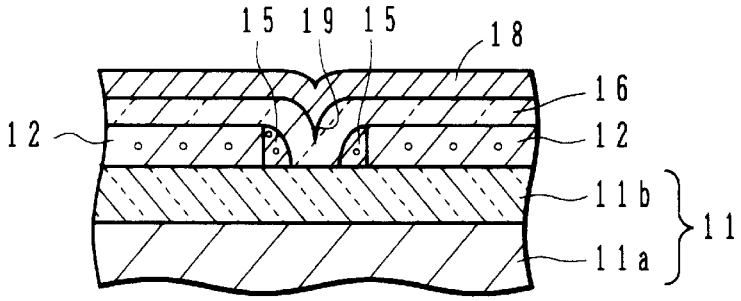
Figure 1G:
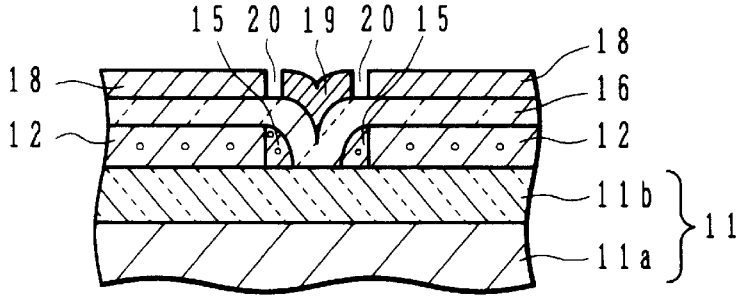
Figure 1H:
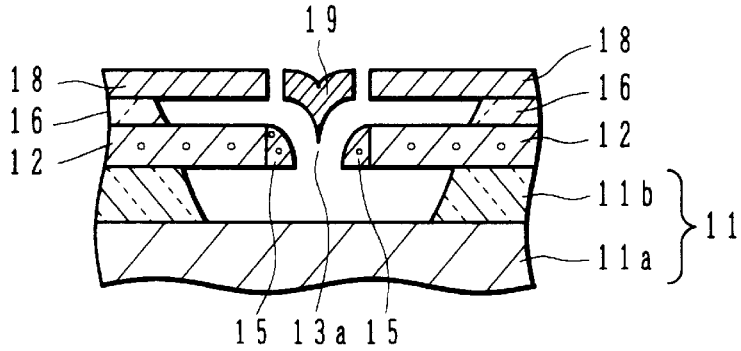

Next, as shown in FIG. 1F, an emitter electrode material film 18 is formed on the silicon oxide film 16. The emitter electrode material film 18 is, for example, a TiN film which can be formed by reactive sputtering using a Ti target and $N_2$+Ar gas. In this manner, a field emission emitter 19 is formed by filling the cusp 17 formed on the surface of the silicon oxide film 16 and self-aligned with the gate openings 13 and 13*a*.

Thereafter, the emitter electrode material film 18 is patterned to form slits 20 by the use of lithography. Through these slit 20, the silicon oxide film 16 under and around the field emission emitter 19 is etched with HF+$NH_4F$ solution, for example, and through the opening 13*a* the silicon oxide film 11*b* is partially etched. This etching may use isotropic wet etching. In this way, the field emission emitter 19 is exposed, and a space including the gate opening 13*a* is formed between the emitter and anode.

The gate opening 13*a* is circular, and the tip of the field emission emitter 19 formed over the gate opening 13*a* is of generally an inverted cone shape. The slit 20 of a stripe shape may take other shapes.

Figure 2:
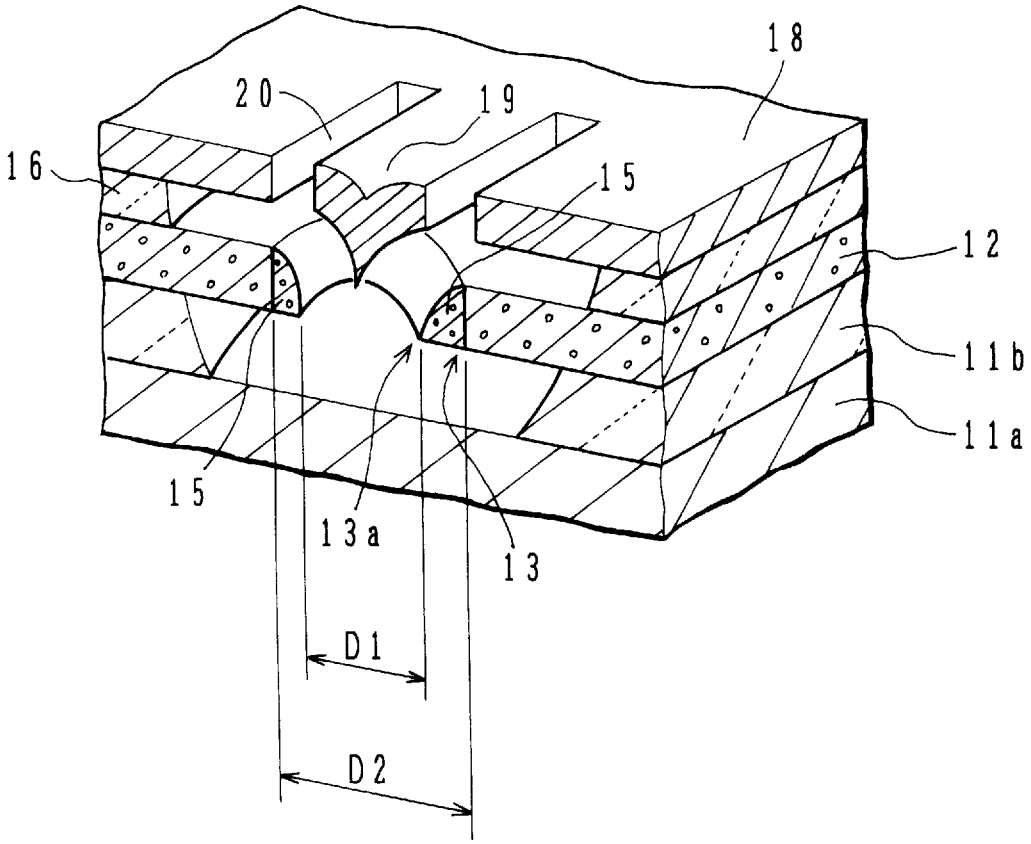
FIG. 2 is a perspective view of the field emission type element shown in FIG. 1H.

FIG. 2 is a perspective view of the field emission type element formed by the manufacture method of the embodiment described above. By vacuum sealing a triode element formed in the above manner, a fine triode vacuum tube can be obtained. With this embodiment, a field emission element having a fine field emission emitter self-aligned and integrally formed with the gate electrode can be realized.

With this embodiment, the diameter of the gate opening can be made smaller than the patterning limit of lithography. As shown in FIG. 2, the diameter D1 of the gate opening 13 formed in the first gate electrode material film 12 is reduced to the diameter D2 of the gate opening 13*a* after the side spacer 15 is formed on the side wall of the gate opening 13. Therefore, even if the diameter D1 is restricted to the patterning limit of lithography, the gate opening 13*a* having the final diameter D1 smaller than the diameter D2 can be formed. It is therefore possible to realize a ultra-fine field emission type element capable of being driven with a relatively low gate voltage.

In this embodiment, the side spacer of the second gate electrode material film forms a slope on the side wall of the gate opening and the volume of the gate opening is reduced. The insulating film formed thereafter by oxidizing or nitriding the gate electrode material film is used as the emitter mold having the cusp with a sharp edge. Accordingly, a field emission emitter having a small apex angle and small radius of curvature of the tip can be formed. The thickness of the insulating film formed by oxidation or nitrification can be highly precisely controlled by the concentration of oxidizing or nitrifying agent or a reaction temperature. Therefore, this control can be performed satisfactorily even if the diameter of the gate opening 13*a* is made small and the insulating film by oxidation or nitrification is made thin. The field emission type element having a short distance between the gate and emitter electrodes can therefore be formed. This is also effective for emitting electrons at a low gate voltage. In this embodiment, the shape of the emitter mold is substantially determined by the shape of the gate opening defined by the side spacer.

In this embodiment, as the material of the anode electrode 11*a*, in place of the doped silicon, other conductive materials made of semiconductor or metal may also be used. As the material of the first and second gate electrode material films, in place of the polysilicon, materials such as amorphous silicon and metal silicide may be used which can form an insulating film through oxidation or nitrification and can increase its volume by the reaction. As the material of the emitter electrode material film 18, other metals may also be used. A laminate metal structure of TiN/W/Al is particularly preferable.

Figure 3A:
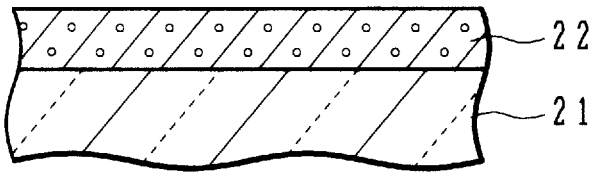
FIGS. 3A to 3G are cross sectional diagrams illustrating the main processes of the manufacture method of a field emission type element according to another embodiment of the invention.

FIGS. 3A to 3G illustrate the main processes of the manufacture method of a field emission type element according to another embodiment of the invention. As shown in FIG. 3A, on an insulating substrate 21, a first polysilicon film 22 as a first gate electrode material film is deposited. Impurities such as phosphorous are doped into the first polysilicon film 22. The insulating substrate 21 may be a quartz substrate, a glass substrate, a silicon substrate with a silicon oxide film formed thereon similar to the first embodiment, or other substrates.

Figure 3B:
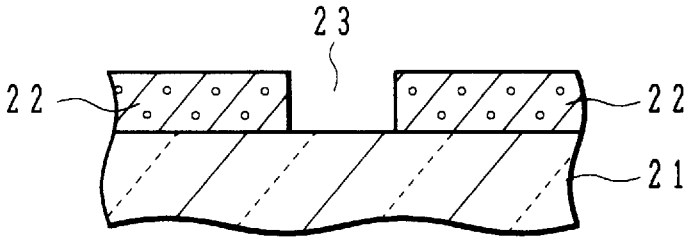

Thereafter, as shown in FIG. 3B, a resist pattern is formed as an etching mask to selectively etch the first polysilicon film 22 and form a gate opening 23. Similar to the first embodiment, anisotropic etching is used to make the gate opening 23 have a vertical side wall or a generally vertical side wall.

Figure 3C:
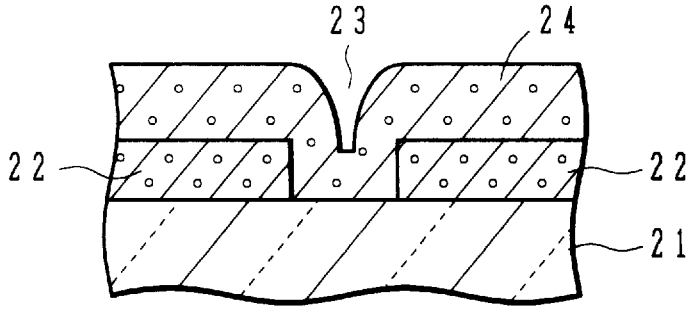

As shown in FIG. 3C, a second polysilicon film 24 as a second gate electrode material film is deposited on the first polysilicon film 22 with the gate opening 23. Impurities such as phosphorous are doped also into this second polysilicon film 24.

Figure 3D:
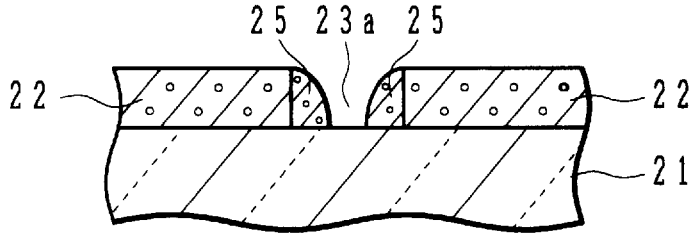

As shown in FIG. 3D, the whole surface of the second polysilicon film 24 is anisotropically dry etched to leave a side spacer 25 on the side wall of the gate opening 23 of the first gate electrode material film 22. This side spacer forms a new gate opening 23*a* having a reduced diameter.

Figure 3E:
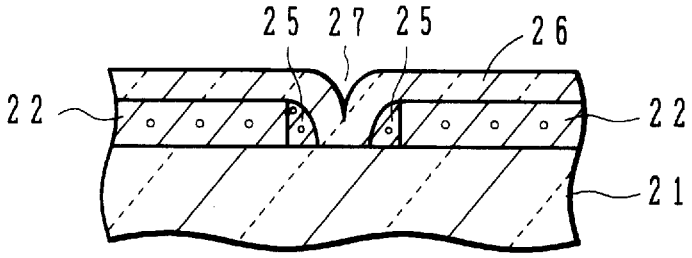

As shown in FIG. 3E, the exposed surface of the first polysilicon film 22 and the side spacer 25 made of polysilicon is oxidized to form a silicon oxide film 26. The silicon oxide film 26 is used as an emitter mold. A cusp 27 having a sharp edge reflecting the shape of the gate opening 23*a* is formed on the surface of the silicon oxide film 26.

Instead of the silicon oxide film 26, a silicon nitride film may be formed.

Figure 3F:
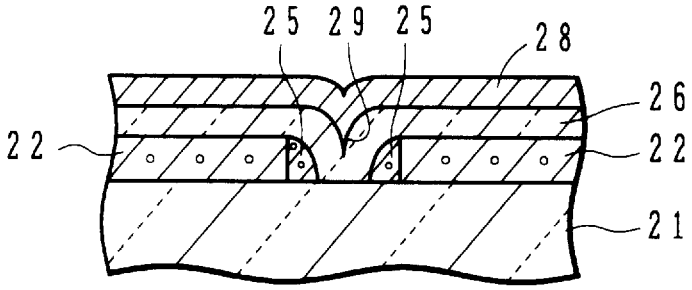

Next, as shown in FIG. 3F, an emitter electrode material film 28 is formed on the silicon oxide film 26. In this manner, a field emission emitter 29 with a sharp tip is formed which fills the cusp 27.

Figure 3G:
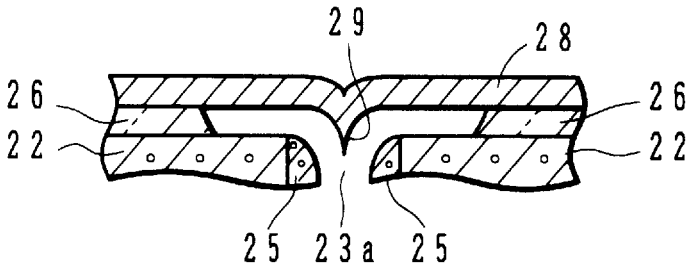

As shown in FIG. 3G, the substrate 21 is etched and removed. By using the first polysilicon film 22 and side spacer 25 as a mask, the silicon oxide film 26 exposed at the gate opening 23*a* is etched through isotropic etching to expose the tip of the field emission emitter 29.

With this embodiment, a field emission type element with a gate electrode and without an anode is formed. Also with this embodiment, from the same reasons described with the first embodiment, a ultra-fine and high performance field emission type element can be achieved.

Figure 4:
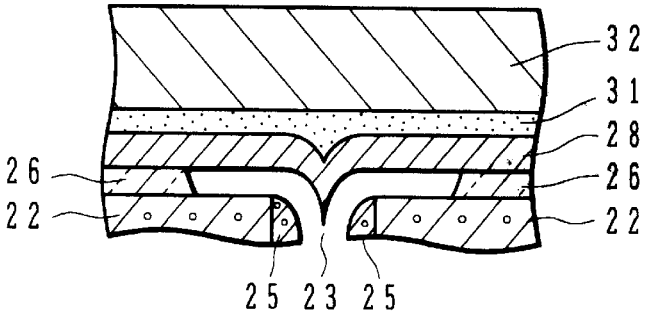
FIGS. 4 to 7 are cross sectional views showing the structure of field emission type elements according to other embodiments of the invention.
Figure 5:
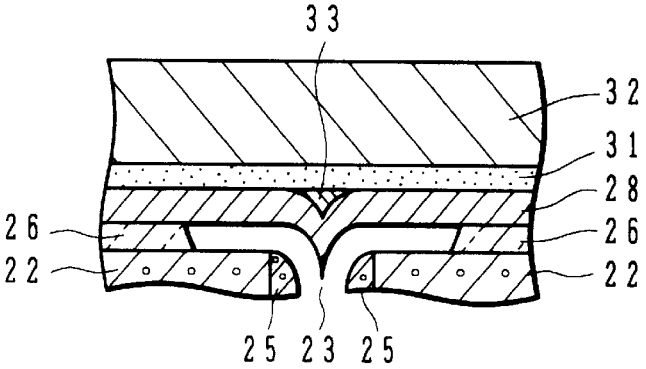

In the above embodiment, as shown in FIG. 4, in order to impart a sufficient mechanical strength to the field emission emitter, it is preferable to bond a support substrate 28 on the emitter electrode material film 28 by adhesive 31 such as epoxy resin or glass of a low melting point, prior to etching and removing the substrate. In this case, a void may be formed if a cusp on the back (upper) surface of the field emission emitter is not completely filled with the adhesive. In order to avoid this, a film 33 such as an SOG (spin-on-glass) film may be coated and etched back or subjected to CMP (chemical mechanical polishing) to planarize the surface thereof.

Figure 6:
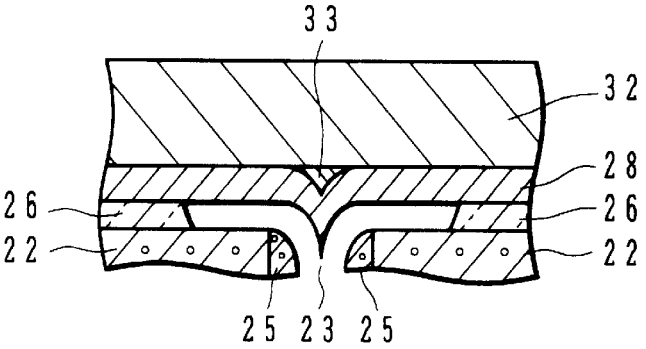

As shown in FIG. 6, if the field emission emitter has a planarized back surface, a support substrate 32 may be directly bonded by electrostatic bonding without using adhesive. Direct bonding eliminates a possible problem of causing a low vacuum by the element due to release of gas contained in epoxy resin and a problem of a short circuit of wiring due to diffusion of Pb components contained in glass of a low melting point.

Figure 7:
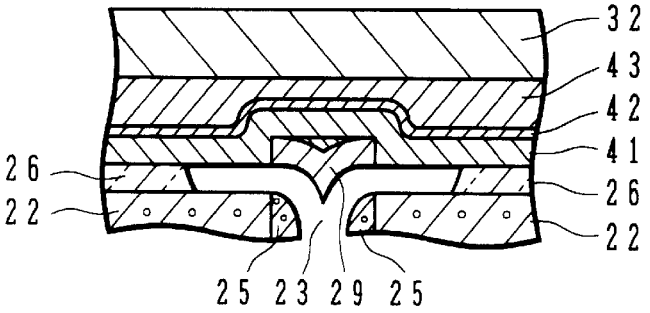

In another embodiment shown in FIG. 7, an emitter electrode material film 28 may be removed while leaving only a field emission emitter 29 and a resistor layer 41 of amorphous Si, polysilicon, or the like is formed over the substrate surface. If a wiring layer of metal such as Al, Cu, and Cr or alloy such as AlSiCu and AlCu is formed directly on the resistor layer 41 made of Si, mutual diffusion occurs. This mutual diffusion changes (reduces) the resistance of the Si resistor layer and may lose the essential function as a resistor. In order to prevent this mutual diffusion, a barrier layer 42 is formed on which an emitter wiring layer 43 is formed. The barrier layer 42 may be a TiN layer, a TiON layer, a TiW layer, a Ti layer, a W layer, or the like, or a laminate thereof. On this wiring layer 43 a support substrate 32 is bonded.

In the above embodiments, a field emission type element having only one field emission emitter has been described.

If a number of gate openings are formed on the substrate for forming emitter molds, a field emitter array (FEA) having a number of emitters can be manufactured. For example, refer to U.S. Ser. No. 08/540,418, 08/544,922, and 08/564,604 which are herein incorporated by reference.

In addition to a point-type field emission emitter with a circular gate opening in plan view, a wedge-type field emission emitter with a rectangular gate opening in plan view may also be manufactured.

The present invention has been described in connection with the preferred embodiments. The invention is not limited only to the above embodiments. It is apparent to those skilled in the art that various modifications, improvements, combinations and the like can be made.

I claim:

1. A method of manufacturing a field emission type element comprising the steps of:

forming a first gate electrode material film on a substrate;

selectively etching said first gate electrode material film to form a gate opening having a substantially vertical side wall;

forming a second gate electrode material film on said first gate electrode material film formed with said gate opening;

anisotropically etching said second gate electrode material film to form a side spacer on the side wall of said gate opening;

reacting the exposed surface of said first gate electrode material film and said side spacer under a reactive ambient to form a film comprising a material selected from a group consisting of oxide and nitride having a cusp with a sharp edge over said gate opening;

forming an emitter electrode material film on said oxide or nitride film to form a tip of a field emission emitter in said cusp; and removing said oxide or nitride film around said field emission emitter.

2. A method of manufacturing a field emission type element according to claim 1, wherein said first and second gate electrode material films are polysilicon.

3. A method of manufacturing a field emission type element according to claim 1, wherein said emitter electrode material film includes a TiN film.

4. A method of manufacturing a field emission type element according to claim 3, wherein said emitter electrode material film includes a TiN/W/Al stack.

5. A method of manufacturing a field emission type element according to claim 1, wherein said selective etching and said anisotropical etching are dry etching.

6. A method of manufacturing a field emission type element according to claim 1, wherein said reactive atmosphere is oxidizing or nitrizing ambient.

* * * * *